US005930961A

United States Patent [19]

Beaudet

[11] Patent Number: 5,930,961

[45] Date of Patent: Aug. 3, 1999

[54] SITE ASSEMBLED EMERGENCY SHELTER

[76] Inventor: Judith Holly Beaudet, 103 Banker Rd., Morrisonville, N.Y. 12962

[21] Appl. No.: 09/095,682

[22] Filed: Jun. 10, 1998

[51] Int. Cl.[6] ..... E04H 9/12

[52] U.S. Cl. ..... 52/169.6; 52/79.4; 52/198

[58] Field of Search ..... 52/169.6, 79.1, 52/79.4, 79.5, 82, DIG. 14, 198, 219, 19, 20, 218

[56] References Cited

U.S. PATENT DOCUMENTS

| | | | |
|---|---|---|---|
| 288,354 | 11/1883 | Mileham . | |
| 951,192 | 3/1910 | Massey . | |
| 2,485,914 | 10/1949 | Owens | 52/82 |
| 2,820,990 | 1/1958 | Johnson | 52/82 |
| 2,871,802 | 2/1959 | Fishler . | |
| 3,138,124 | 6/1964 | Baier | 52/169.6 |
| 3,196,813 | 7/1965 | McHugh, Jr. | 52/169.6 |
| 3,212,220 | 10/1965 | Boniecki et al. . | |
| 3,562,975 | 2/1971 | Moss | 52/82 |
| 3,974,599 | 8/1976 | Grosh . | |
| 4,507,899 | 4/1985 | Janitzky . | |
| 4,534,144 | 8/1985 | Gustafsson et al. . | |
| 4,615,158 | 10/1986 | Thornton . | |
| 4,642,952 | 2/1987 | Prandin | 52/169.6 |
| 4,660,334 | 4/1987 | McCarthy . | |
| 4,709,723 | 12/1987 | Sidaway et al. . | |
| 4,805,360 | 2/1989 | Kuehnl . | |
| 4,955,166 | 9/1990 | Qualline et al. . | |
| 5,611,178 | 3/1997 | Aubert . | |

FOREIGN PATENT DOCUMENTS

| | | |
|---|---|---|
| 46670 | 8/1939 | Netherlands . |
| 2081766 | 5/1980 | United Kingdom . |

*Primary Examiner*—Michael Safavi
*Attorney, Agent, or Firm*—Edward M. Livingston, Esq.

[57] ABSTRACT

A site-assembled emergency shelter has matching site-assembly portions (21) that can be juxtaposed adjacently for low-volume packaging for shipment and then assembled on site. A wide selection of sizes and shapes are included. For different shelter uses, objectives and preferences, different structural materials such as fiberglass, some aluminum alloys, some stainless-steel alloys and other materials can be selected for appearance, endurance, weight, strength, cost and other factors. Installation components such as ground anchors (10, 11, 18), air circulators (9), accesses (4, 5), handling members (8), flotation ballasts (12) and communications (13) are provided.

22 Claims, 8 Drawing Sheets

SITE ASSEMBLED EMERGENCY SHELTER

BACKGROUND OF THE INVENTION

This invention relates to emergency shelters for protection against tornados, hurricanes, floods, fire, earthquakes, burglary, bombs and other hazards.

A variety of emergency shelters previously have been site-constructed of cement, steel, fiberglass and other materials for particular uses. Others have been manufactured in an assembled condition for particular applications. None are known to be site-assembled from matching parts as taught by this invention.

Examples of different but related emergency shelters are described in the following patent documents. U.S. Pat. No. 5,611,178, issued to Aubert on Mar. 18, 1997, described a tunnel-like structure made of corrugated metallic half shells. U.S. Pat. No. 4,955,166, issued to Qualline, et al. on Sep. 11, 1990, described a tornado underground shelter having a truncated spherical form. U.S. Pat. No. 4,805,360, issued to Kuehnl on Feb. 21, 1989, described an underground supply room for supplying goods and services to vendors in a retail outlet above it in a parking lot. U.S. Pat. No. 4,660,334, issued to McCarthy on Apr. 28, 1987, described a blast shelter with a separate command station. U.S. Pat. No. 4,615,158, issued to Thornton on Oct. 7, 1986, described a mobile-home tornado shelter with a ladder leading from a trailer lot. U.S. Pat. No. 4,534,144, issued to Gustafsson, et al. on Aug. 13, 1985, described an underground bomb shelter with cellular storage compartments. U.S. Pat. No. 3,212,220, issued to Boniecki, et al. on Oct. 19, 1965, described an "ovaloid" or egg-shaped shelter. U.S. Pat. No. 288,354, issued to Mileham on Nov. 13, 1883, described a cylindrical cyclone refuge.

Regardless of catastrophic damages that occur from tornados, hurricanes, floods, fire, earthquakes, burglary, bombs and other hazards, relatively little protection against them is provided because of variously prohibitive problems with present protection alternatives. The most expensive alternative is insurance which is designed for replacement compensation instead of prevention of irreplaceable losses from major hazards.

SUMMARY OF THE INVENTION

In light of these problems, objects of patentable novelty and utility taught by this invention are to provide a site-assembled emergency shelter which:

Can be produced at sufficiently low cost to merit its unlikely but perilous need;

Can be structured for protection against a wide selection of hazards;

Can be marketed either assembled or unassembled;

Can be packaged for low-bulk, inexpensive and convenient transport;

Is relatively easy for an inexperienced person to assemble;

Can be made in sizes to meet different use requirements;

Can be positioned underground for protection against such hazards as tornados, hurricanes, fire, bombs and fallout;

Can be positioned partially underground and partially above ground for protection against hurricanes, floods and earthquakes;

Can be positioned underfloor for protection against burglary in addition to all of the above;

Can be used for storage of food and water to meet disaster needs; and

Can be used as an annex to a building.

This invention accomplishes these and other objectives with a site-assembled emergency shelter having matching shelter portions that can be juxtaposed adjacently for low-volume packaging for shipment and then assembled on site. A wide selection of sizes and shapes are included. For different shelter uses, objectives and preferences, different structural materials such as fiberglass, some aluminum alloys, some stainless-steel alloys and other materials can be selected for appearance, endurance, weight, strength, cost and other factors. Installation components such as ground anchors, air circulators, accesses, handling members, flotation ballasts and communications are provided.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

| | | | |
|---|---|---|---|
| 1. | Base portion | 15. | Escape hatch |
| 2. | Wall portion | 16. | Slide pole |
| 3. | Roof portion | 17. | Rungs |
| 4. | Door | 18. | Ground |
| 5. | Hatchway | 19. | Building |
| 6. | Hatchway closure | 20. | Curved joining edges |
| 7. | Hinges | 21. | Site-assembly portions |
| 8. | Lift-hook attachments | 22. | Straight joining edges |
| 9. | Air conveyance | 23. | Curve joiner |
| 10. | Anchor line | 24. | Plane joiner |
| 11. | Land anchor | 25. | Joiner walls |
| 12. | Ballast tank | 26. | Joiner bolts |
| 13. | Ariel | 27. | Shipping containers |
| 14. | Under-building safe room | 28. | Transom |

Referring first to FIGS. 1 and 9–14, a site-assembled emergency shelter has a base portion 1, a wall portion 2 and a roof portion 3 with site-assembly portions that fit together juxtaposed adjacently in an unassembled mode, as shown in FIGS. 9–13, for transportation.

Figure 1:
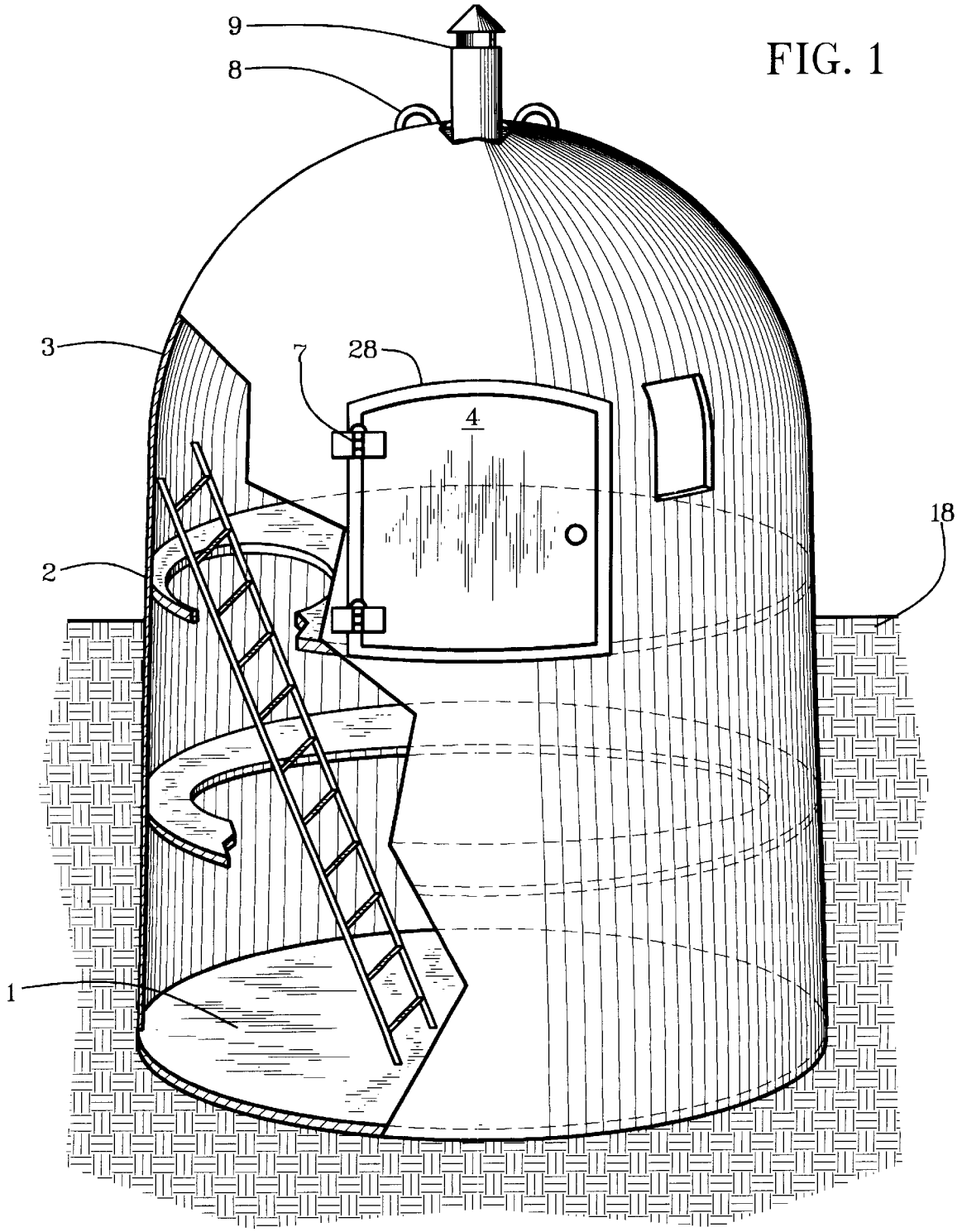
FIG. 1 is a partially cutaway perspective view of a domed cylindrical shelter partially in the ground.
Figure 2:
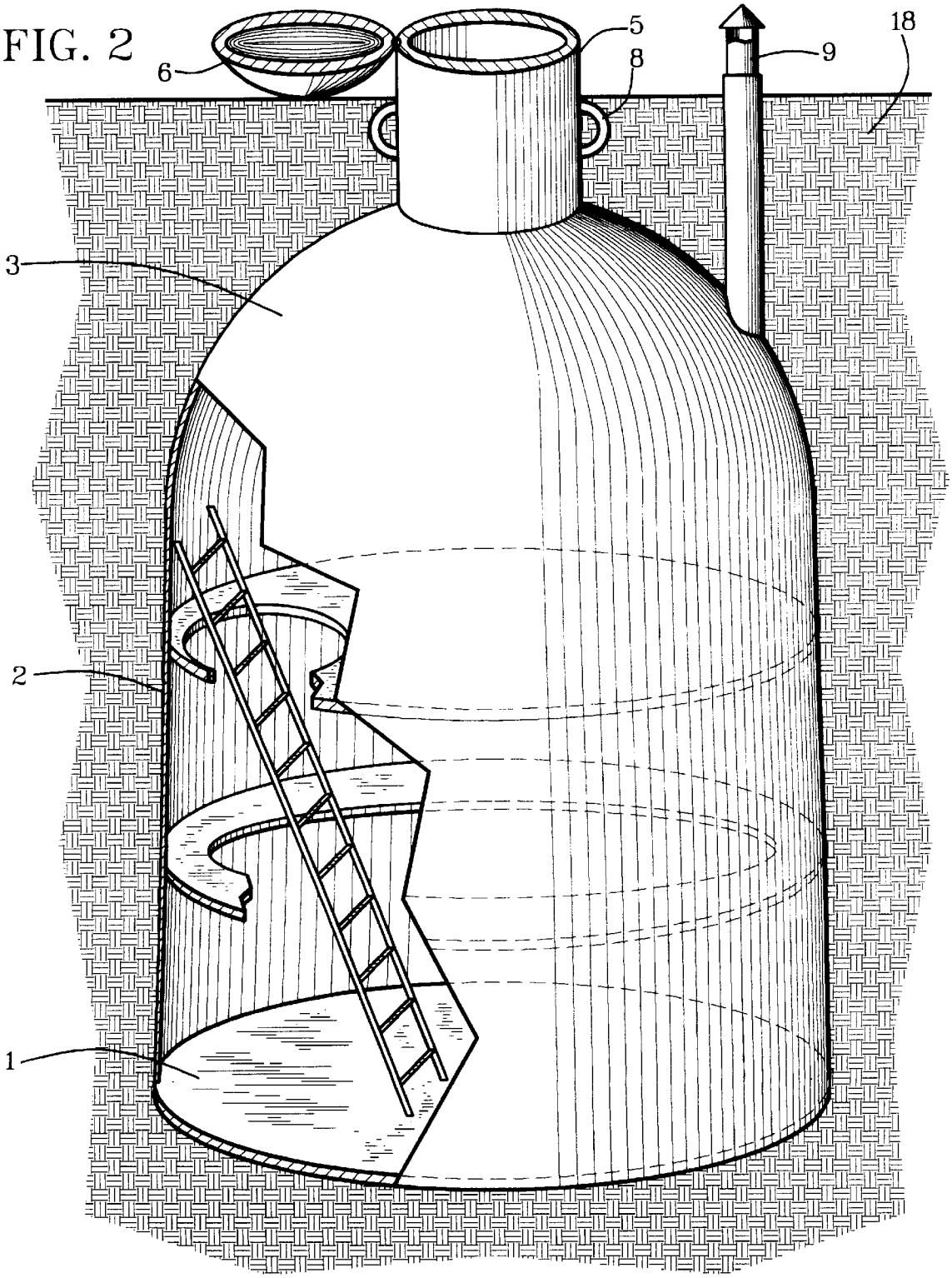
FIG. 2 is a partially cutaway perspective view of a domed cylindrical shelter underground except for an entrance hatch.
Figure 3:
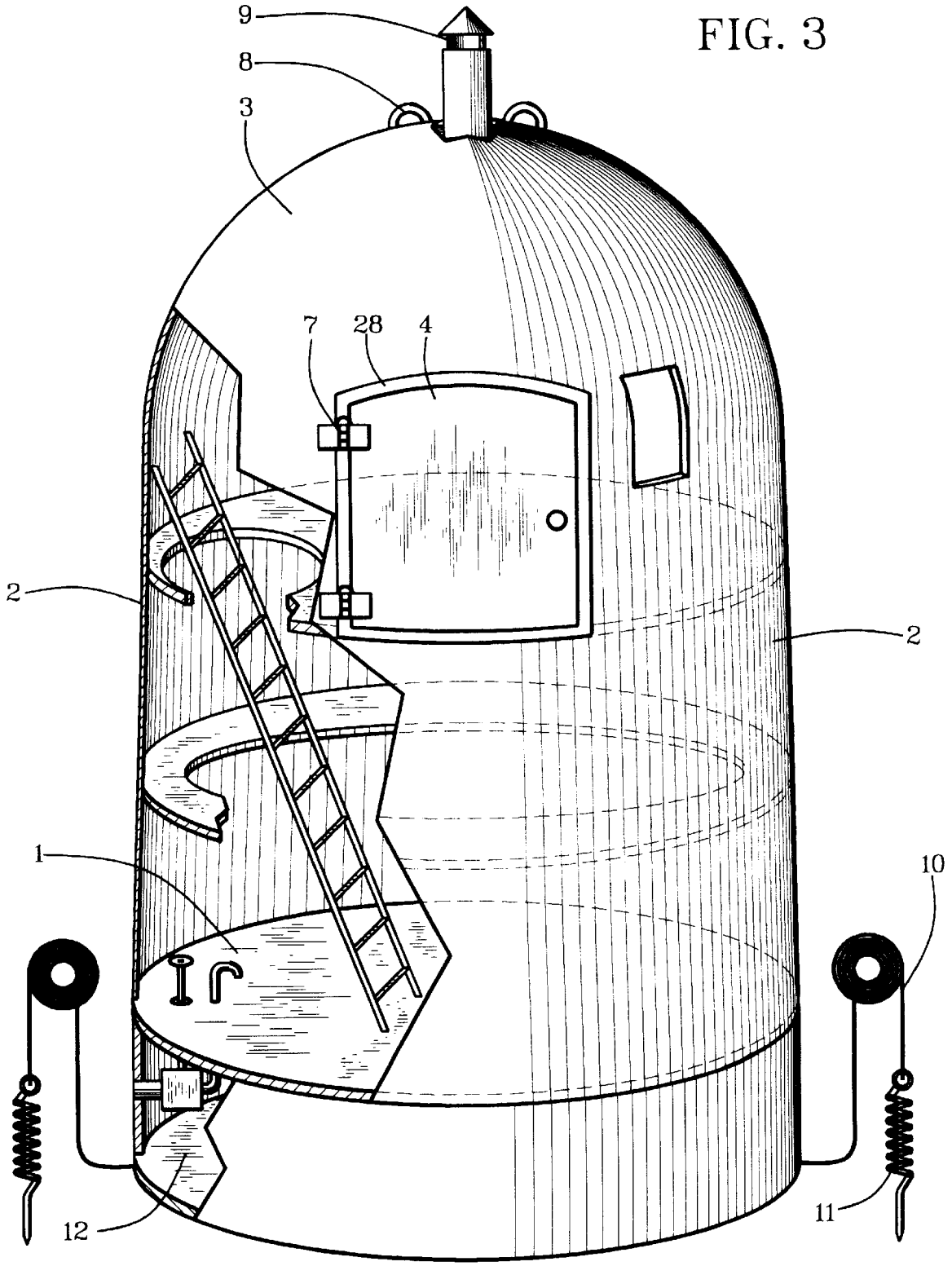
FIG. 3 is a partially cutaway perspective view of a domed cylindrical shelter partially having a tie-down line and a ballast tank for floating in the event of floods.
Figure 4:
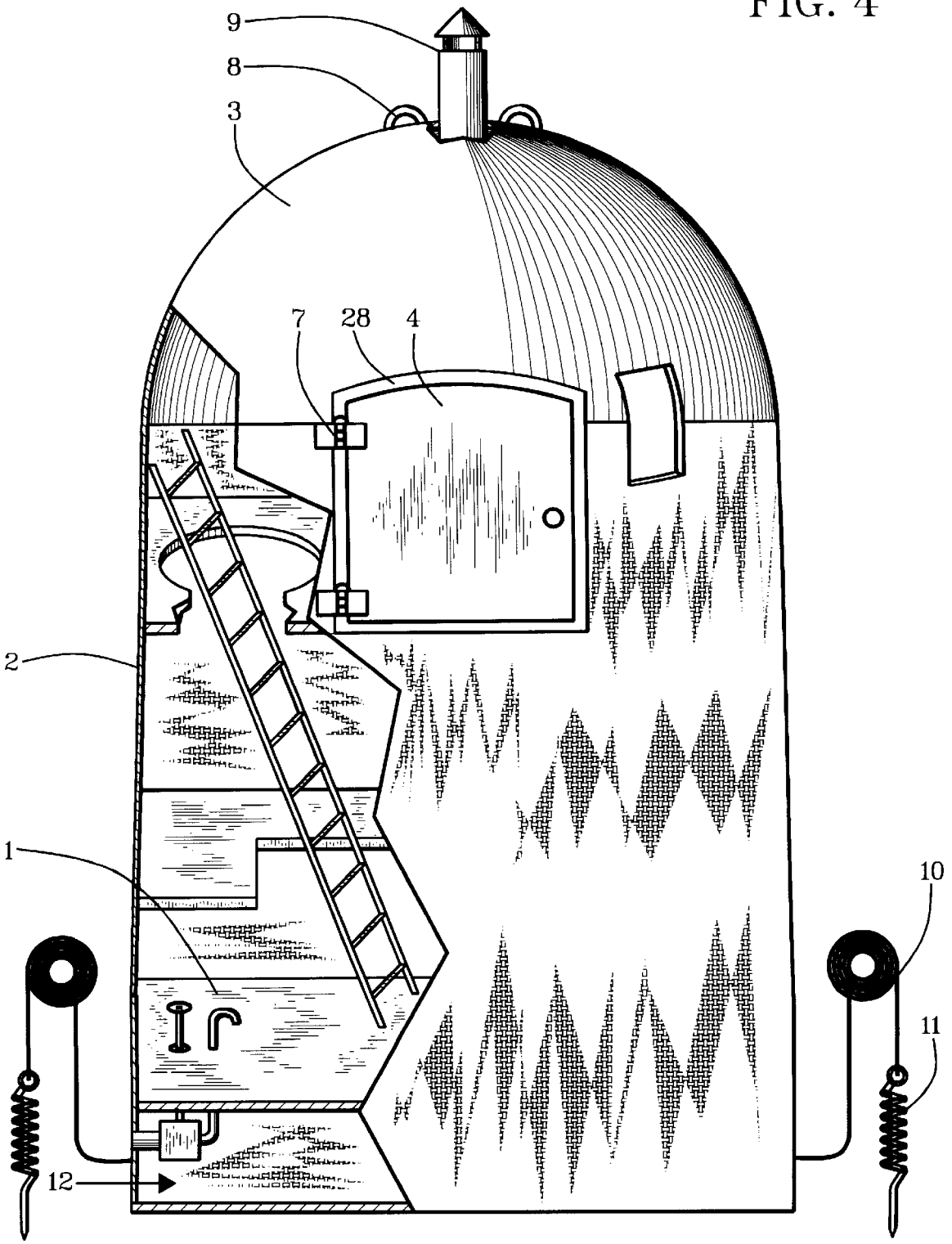
FIG. 4 is a partially cutaway perspective view of a domed cubical or rectangularly domed shelter having a tie-down line and a ballast tank for floating protection from flooding.
Figure 5:
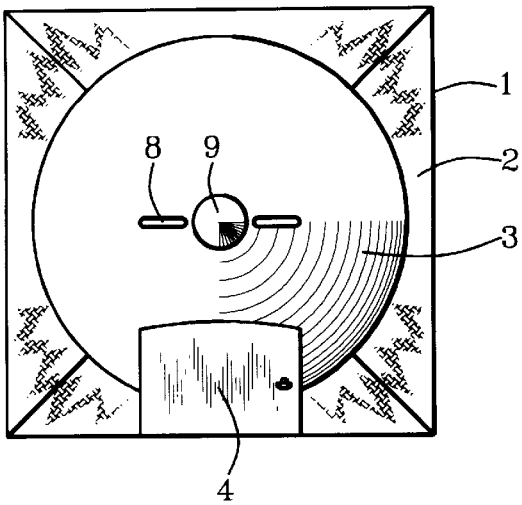
FIG. 5 is a top view of a cubically domed shelter.
Figure 6:
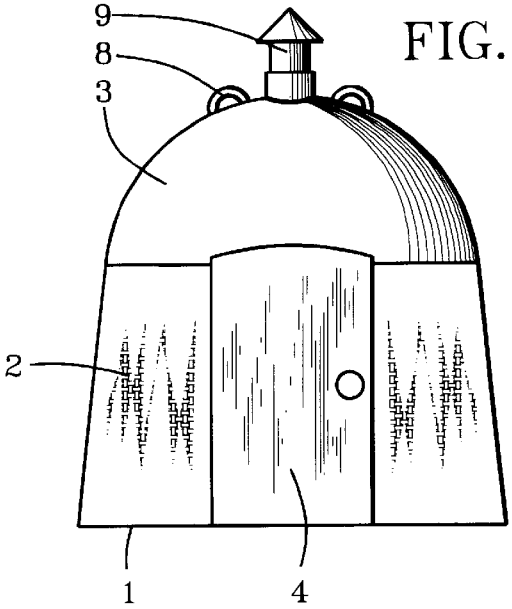
FIG. 6 is a front view of the FIG. 5 illustration.
Figure 7:
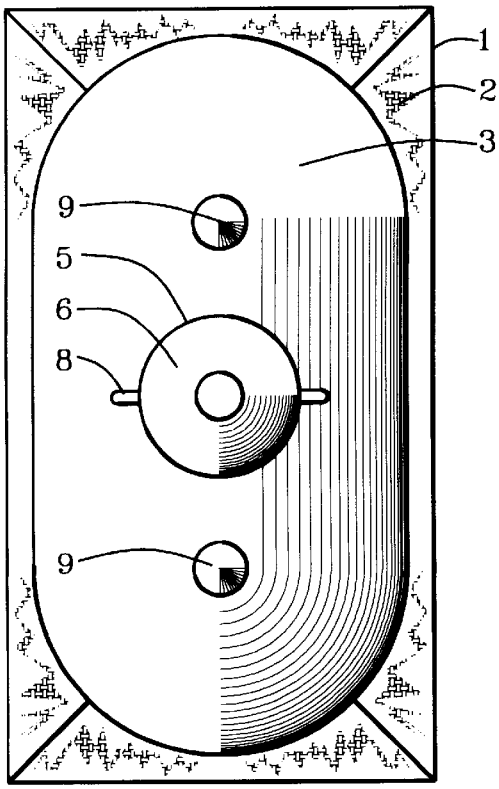
FIG. 7 is a top view of a rectangularly domed shelter.
Figure 8:
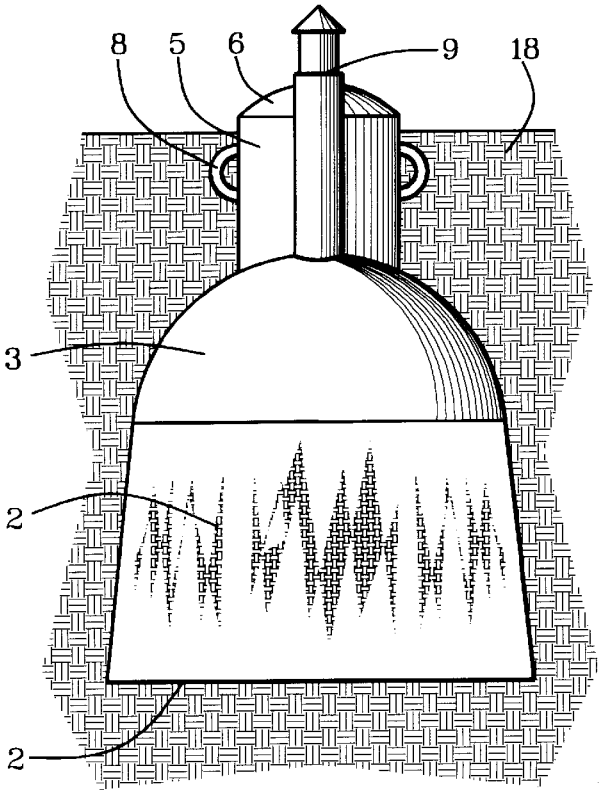
FIG. 8 is a side view of the FIG. 7 illustration underground.
Figure 19:
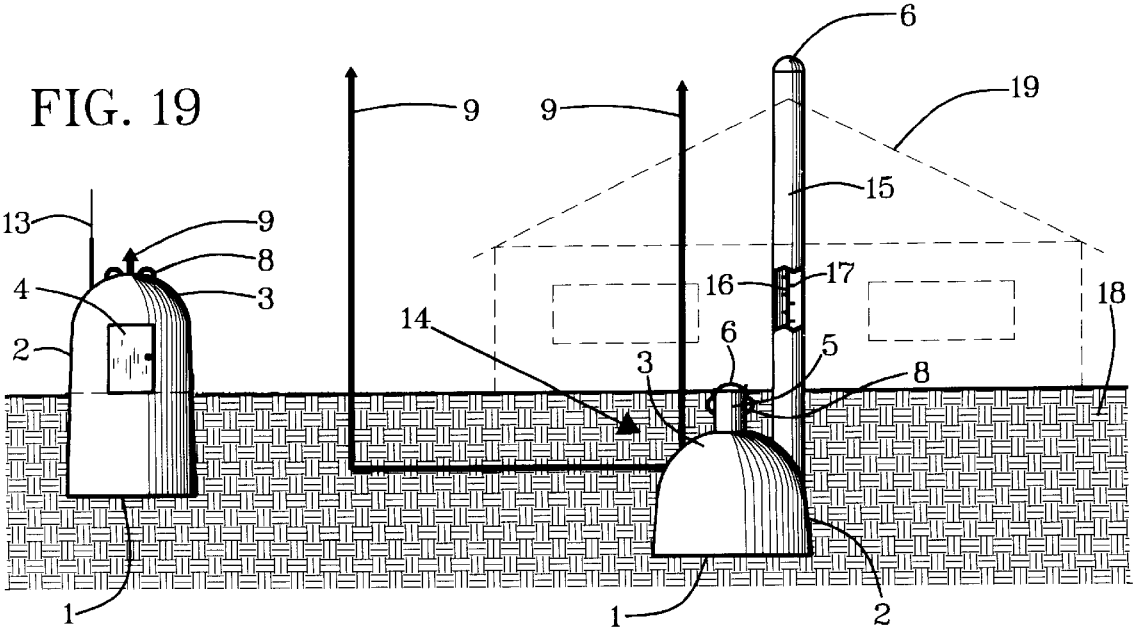
FIG. 19 is a side view of an under-building shelter and a partially underground shelter in relationship to a building.
Figure 20:
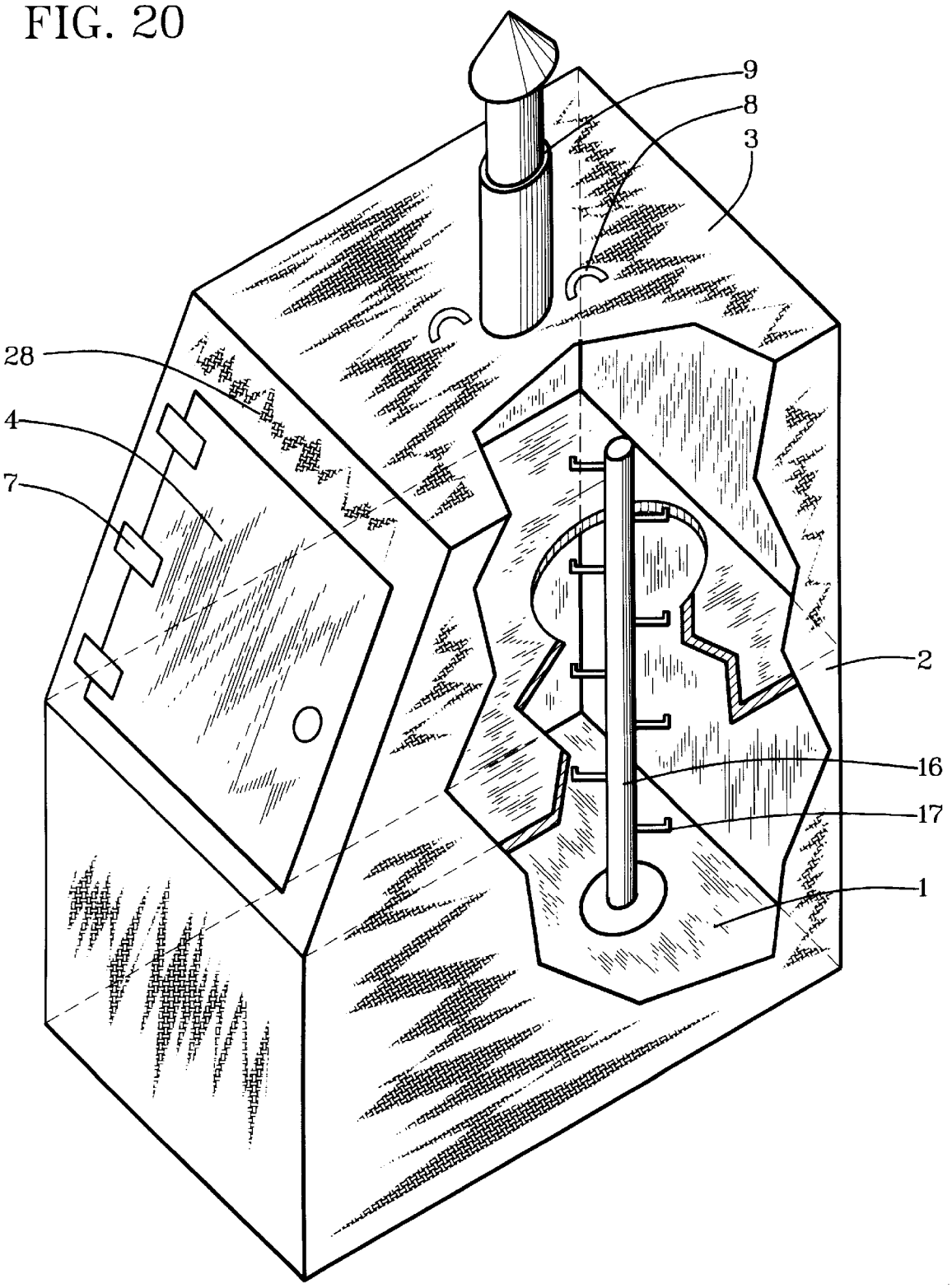
FIG. 20 is a partially cutaway perspective view of a rectangular shelter with a slanted door.

Referring to FIGS. 1–8, 19, and 20, the wall portion 2 can be vertically cylindrical with preferably but not necessarily a slight taper and the base portion 1 correspondingly circular as depicted in FIGS. 1–3. Optionally as desired, the wall portion 2 can be vertically rectangular with or without a slight taper and the base portion 1 square as indicated in FIGS. 4–6. Further optionally, the wall portion 2 can be horizontally rectangular and the base portion 1 correspondingly rectangular as depicted in FIGS. 7–8. As shown in FIG. 20, the wall portion 2 and the base portion 1 both can be rectangular.

Tapering of the wall portion 2 provides not only structural rigidity but also a positioning means by being wedged under ground as shown in FIGS. 1 and 19. A positioning means also is provided by structural capacity to support ground overburden on the roof portion 3 as shown in FIGS. 2, 8 and 19.

At least one securable access to an inside periphery of the site-assembled emergency shelter is provided by optionally a door 4 as shown in FIGS. 1, 3–6 and 19–20 or a hatchway 5 with a hatchway closure 6 as shown in FIGS. 2, 7–8, and 19. The door 4 is preferably a flotation member that can be removed from its hinges 7.

Lift-hook attachments 8, as depicted in FIGS. 1–8 and 19–20, are provided to aid on-site assembly and mobility after assembly.

An air conveyance 9 as indicated in FIGS. 1–8 and 19–20 is preferably a telescopic tube in securable communication with an outside source of clean air and an inside periphery of the site-assembled emergency shelter. Securement of the air supply can be with an air conveyance 9 that is telescopic as shown in FIGS. 1–8 and 19–20 but also can be positioned permanently in a secure position such as indicated also in FIG. 19.

An anchor line 10 attached to a land anchor 11, as shown in FIGS. 3–4 is a positioning means for sheltering protection against floods. The anchor line 10 is preferably sufficiently long to anchor in flood water as deep as probable for a particular area. The anchor line 10 also is preferably releasable.

To aid verticality of buoyance, a ballast tank 12 shown in FIGS. 3–4 can be provided in a bottom of site-assembled emergency shelters that are intended for positioning on the ground or partially in the ground. The ballast tank 12 is preferably for potable water or other fluid that is stored in the ballast tank 12 for emergencies. Flood water also can be used for ballast as shown by outside connections.

Two stories as shown in FIGS. 1–4, 19 and 20 can be provided not only for people capacity but also for storage of food, water, communications equipment, flotation devices and survival equipment such as fishing and hunting implements. The horizontally rectangular site-assembled emergency shelter underground with a fast-entry hatchway as shown in FIGS. 7–8 is preferable for some conditions such as near schools.

An ariel 13 shown in FIG. 19 can be provided in the event of failure or unavailability of satellite communications.

An under-building safe room 14 with a hatchway closure 6 as shown in FIG. 19 can shelter against a plurality of hazards such as burglary, tornados, hurricanes, flood, fire, earthquakes and bombs. For maximum protection, the hatchway closure 6 is optionally sealable from the inside, has a plurality of particularly secure air conveyances 9 and has an alternate escape route through an escape hatch 15 such as oil-well casing that is made of steel and extends high enough to prevent entry of burglars or flood water. Preferably, the escape hatch 15 also has an inside-sealable hatchway closure 6.

Figure 18:
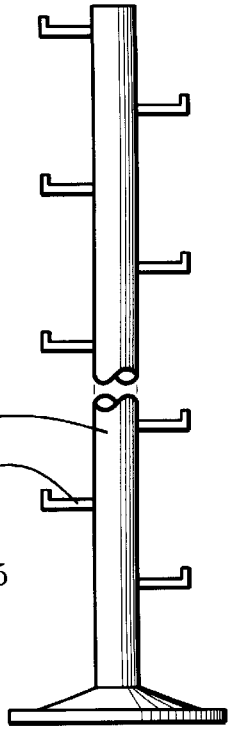
FIG. 18 is a partially cutaway side view of a pole ladder for shelter hatchways.

For convenience in vertical access through hatchways, through the escape hatch 15 and from-floor-to-floor of a multiple-storied shelter, a pole ladder having a slide pole 16 and positional rungs 17 as shown in FIGS. 18–20 can be used. The rungs 17 can be left off for sliding down the slide pole 16 for fast entrance and then hand-positioned conveniently for going up the pole ladder. This is a particularly convenient and space-saving use of oil-well casing or other tubing for the escape hatch 15. A burglar coming down it if possible to enter it, could be stopped and trapped by a closure entrance into the site-assembled emergency shelter.

An annex of shelter rooms as conveniently positioned in relation to a dwelling as indicated in FIG. 19 can be used for common purposes such as a quiet room, a study, a bedroom or a storage room in addition to use for sheltering against intended hazards. They can also have access to air conditioning or heating if needed under ground 18 proximate a building 19.

Referring to FIGS. 9–17, curved joining edges 20 that are side-joining edges of site-assembly portions 21 can be joined and sealed with any of a selection of known means for joining metal if metal is used or for joining fiberglass if fiberglass or other plastic material is used for construction of an intended emergency shelter. Similarly, straight joining edges 22 that are side-joining edges of site-assembly portions 21 can be joined and sealed with any of a selection of known means for joining metal if metal is used or for joining fiberglass if fiberglass or other plastic material is used for construction of an intended emergency shelter.

Figure 14:
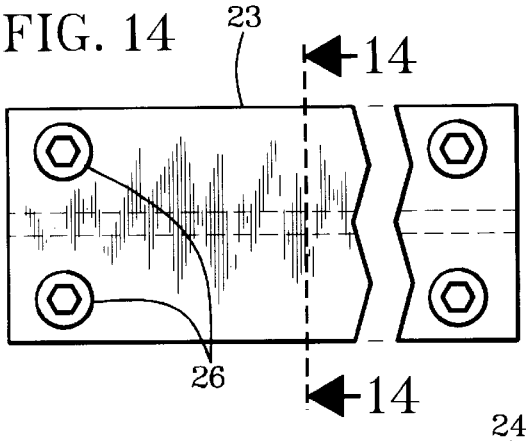
FIG. 14 is a partially cutaway side view of a curve joiner.
Figure 15:
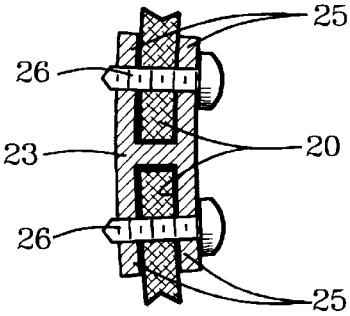
FIG. 15 is a cross-sectional view of the cylindrical joint taken through line 14—14 of FIG. 14.
Figure 16:
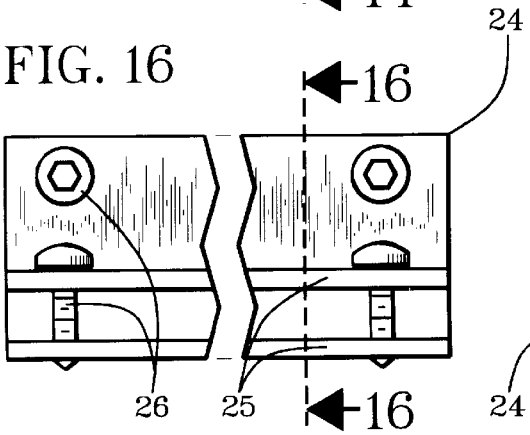
FIG. 16 is a partially cutaway side view of a plane joiner.
Figure 17:
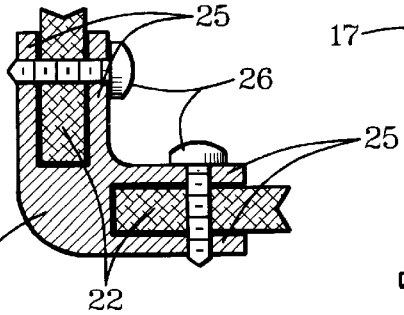
FIG. 17 is a cross-sectional view of the angle joint taken through line 16—16 of FIG. 16.

Regardless of which type of material is used for construction of intended emergency shelters, a preferred means for joining curved joining edges 20 is with a curve joiner 23 shown in FIGS. 14–15 and a preferred means for joining straight joining edges 22 is with a plane joiner 24 as shown in FIGS. 16–17. Both have length approximately equal to lengths of material to be joined. Both have material channels between joiner walls 25 and both have joiner bolts 26 that are used to force the joiner walls 25 together against opposite sides of material 20 and 22 positioned between the joiner walls 25. A cement for some relatively plastic materials and a gasket for relatively hard structural materials can be positioned on opposite sides of the structural materials 20 and 22 to aid tightness of sealing. Angles between oppositely disposed channels having joiner walls 25 can be structured for particular shelter designs.

Figure 9:
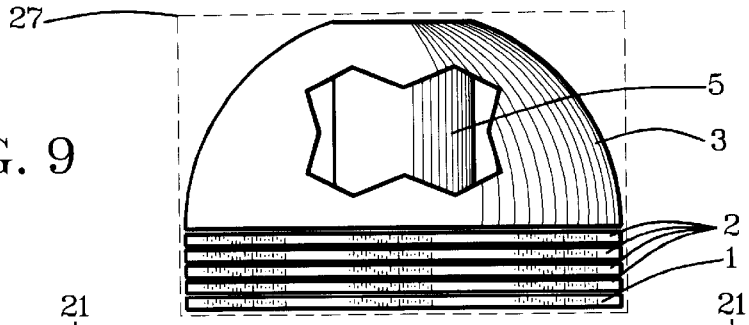
FIG. 9 is a partially cutaway side view of a cubically domed shelter in pieces for packaging and transportation before being site-assembled.
Figure 10:
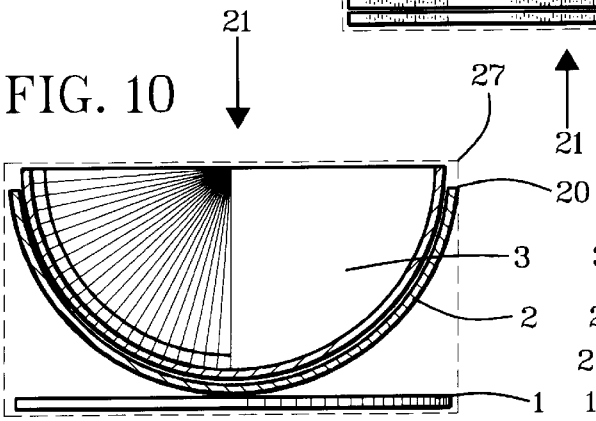
FIG. 10 is an end view of a cylindrically domed shelter in pieces for packaging and transportation before being site-assembled.
Figure 11:
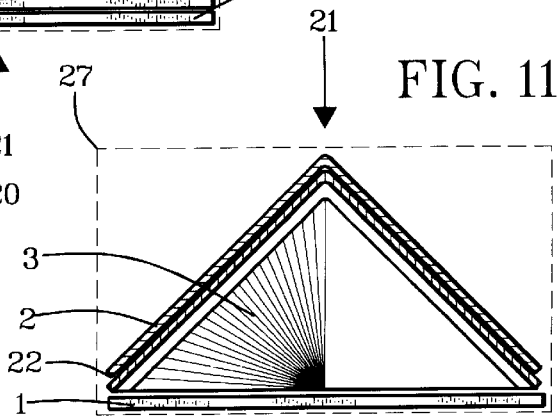
FIG. 11 is an end view of a cubical shelter in pieces for packaging and transportation before being site-assembled.
Figure 12:
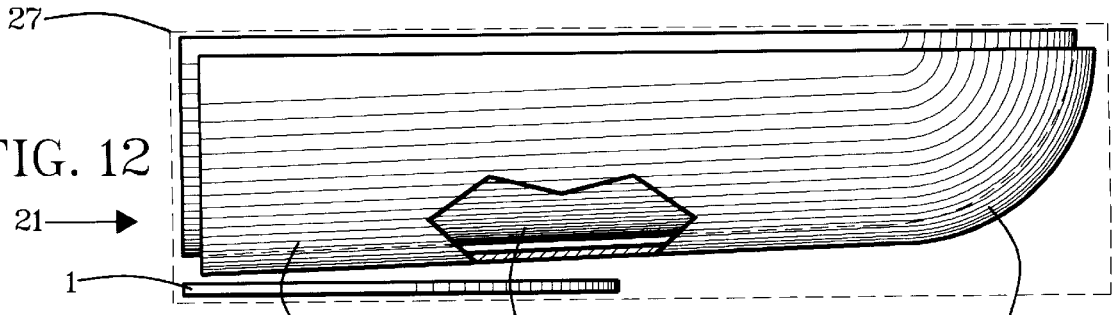
FIG. 12 is a partially cutaway side view of a cylindrically domed shelter in pieces for packaging and transportation before being site-assembled.
Figure 13:
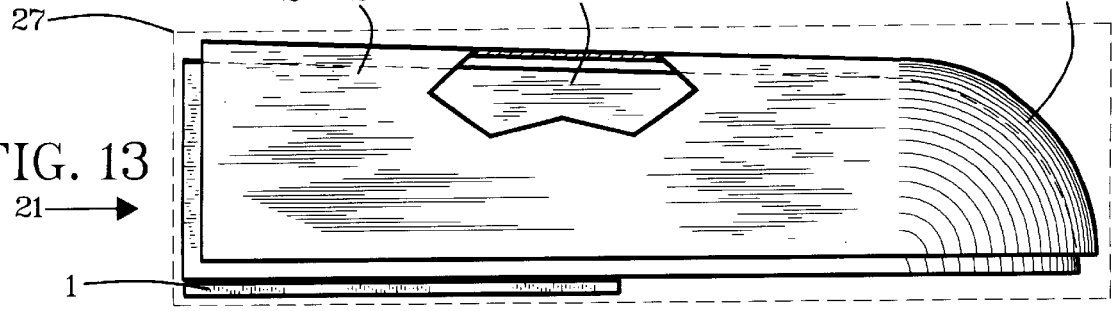
FIG. 13 is a partially cutaway side view of a cubically domed shelter in pieces for packaging and transportation before being site-assembled.

As shown in FIGS. 9–13, the site-assembly portions 21 of intended emergency shelters or of the base portion 1, the wall portion 2 or the roof portion 3 thereof are made to fit juxtaposed adjacently for transportation in shipping containers 27 that are represented generally by dashed lines. Site-assembly portions 21 of rectangularly shaped emergency shelters can be single sides 2 stacked for shipment as shown in FIG. 9 with a dome-shaped top portion 3 and peripheral components packaged on top of them. Circular or cylindrical site-assembly portions 21 or optionally, rectangular site-assembly portions 21 can be structured as enclosure portions as shown in FIGS. 10–13 and juxtaposed adjacently for shipment.

As shown in FIGS. 1, 3–4 and 20, doors 4 of intended emergency shelters having them instead of hatchways 5 can have transoms 28 that provide structural integrity.

A new and useful site-assembled emergency shelter having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A site-assembled emergency shelter comprising:

a base portion, a wall portion and a roof portion having site-assembly portions of an intended emergency shelter which fit together juxtaposed adjacently in an unassembled mode for transportation;

adjoining edges of the site-assembly portions of the base portion, the wall portion and the roof portion which are joined for on-site assembly of the site-assembled emergency shelter;

at least one securable access to an inside periphery of the site-assembled emergency shelter;

at least one securable air conveyance to the inside periphery of the site-assembled emergency shelter wherein the at least one securable air conveyance is telescopic for positioning vertically; and at least one positioning means with which the site-assembled emergency shelter is positioned at a site for an intended emergency sheltering.

2. A site-assembled emergency shelter as described in claim 1 wherein:

the base portion is circular and substantially flat, the wall portion is cylindrical and the roof portion is hemispherical, such that the site-assembled emergency shelter is a domed cylinder with a flat bottom.

3. A site-assembled emergency shelter as described in claim 2 wherein:

the site-assembly portions of the intended emergency shelter have a plurality of side-adjoining edges that are arcuate at roof portions and linear at wall portions of the site-assembly portions;

the site-assembly portions have base-adjoining edges proximate bottoms of the site-assembly portions;

the base portion has structure separate from the wall portion; and the base portion has wall-adjoining edges that coincide with the base-adjoining edges of the site-assembly portions proximate a circumferential periphery of the base portion.

4. A site-assembled emergency shelter as described in claim 3 wherein:

the side-adjoining edges are tightly joinable adjacently on site; and the base-adjoining edges are tightly joinable to the wall-adjoining edges on site.

5. A site-assembled emergency shelter as described in claim 1 wherein:

the at least one access includes a tightly sealable door proximate the wall portion of the site-assembly emergency shelter.

6. A site-assembled emergency shelter as described in claim 1 wherein:

the at least one access includes a tightly sealable hatchway in the roof of the site-assembly emergency shelter.

7. A site-assembled emergency shelter as described in claim 1 wherein:

the intended emergency sheltering is from hazards not requiring ground overburden for protection; and the positioning means is at least one anchor line attached to a land anchor.

8. A site-assembled emergency shelter as described in claim 7 and further comprising:

a ballast tank proximate the base portion.

9. A site-assembled emergency shelter as described in claim 1 wherein:

the intended emergency sheltering is from hazards requiring ground overburden for protection; and the positioning means is structural strength of the site-assembled emergency shelter to support protective ground overburden.

10. A site-assembled emergency shelter as described in claim 1 wherein:

the base portion is rectangular and substantially flat, the wall portion is rectangularly cubical and the roof portion is rectangularly domed, such that the site-assembled emergency shelter is a rectangularly domed cubical with a flat bottom.

11. A site-assembled emergency shelter as described in claim 10 wherein:

the wall portion and the roof portion have a plurality of site-assembly portions with side-adjoining edges that are arcuate at roof portions of the site-assembly portions and linear at wall portions of the site-assembly portions;

site-assembly side portions have base-adjoining edges proximate bottoms of the site-assembly side portions;

the base portion has structure separate from the wall portion; and the base portion has wall-adjoining edges that coincide with the base-adjoining edges of the site-assembly side portions proximate a circumferential periphery of the base portion.

12. A site-assembled emergency shelter as described in claim 11 wherein:

the side-adjoining edges are tightly joinable adjacently on site; and the base-adjoining edges are tightly joinable to the wall-adjoining edges on site.

13. A site-assembled emergency shelter as described in claim 1 wherein:

material with which the site-assembled shelter is constructed is rigid and selected for such factors as strength, weight, durability, cost, sealing capacity and ease of on-site assembly.

14. A site-assembled emergency shelter as described in claim 1 and further comprising:

structure of the site-assembled emergency shelter which supports electronic communications externally from within the site-assembled emergency shelter.

15. A site-assembled emergency shelter as described in claim 1 and further comprising:

structure of the site-assembled emergency shelter which supports emergency storage of life-support items such as food, water, flotation devices, hunting equipment and fishing equipment.

16. A site-assembled emergency shelter as described in claim 1 wherein:

the site-assembled emergency shelter is structured and positioned in proximity to a building for use as an annex to the building.

17. A site-assembled emergency shelter as described in claim 1 wherein:

the intended emergency sheltering is from hazards not requiring ground overburden for protection; and the positioning means is outwardly tapering of a bottom of the wall portion against which earth overburden can be positioned to prevent upward dislodgement of the intended emergency shelter.

18. A site-assembled emergency shelter as described in claim 1 and further comprising:

a potable-water tank proximate a bottom of the intended emergency shelter.

19. A site-assembled emergency shelter as described in claim 18 wherein:

the potable-water tank is sized, shaped, structured and positioned as a water ballast to provide verticality of buoyance of the intended emergency shelter for sheltering protection against flood waters.

20. A site-assembled emergency shelter as described in claim 1 and further comprising:

a lift-hook attachment for site assembly with aid of lifting mechanisms.

21. A site-assembled emergency shelter as described in claim 1 wherein:

the intended emergency shelter is a building annex that is positioned vertically below the building for sheltering protection from a plurality of hazards such as burglary, fire, tornados, hurricanes, floods and earthquakes.

22. A site-assembled emergency shelter as described in claim 21 and further comprising:

a backup escape hatch with an opening in a safe position from an intended plurality of hazards.

* * * * *